US010392841B2

(12) United States Patent
Kopp, Sr. et al.

(10) Patent No.: US 10,392,841 B2
(45) Date of Patent: Aug. 27, 2019

(54) DOOR SECURITY DEVICE

(71) Applicant: Lockdown International, LLC, Huntersville, NC (US)

(72) Inventors: Christopher Paul Kopp, Sr., Concord, NC (US); Daniel Pompei Cedrone, Huntersville, NC (US)

(73) Assignee: LOCKDOWN INTERNATIONAL, LLC, Huntersville, NC (US)

( * ) Notice: Subject to any disclaimer, the term of this patent is extended or adjusted under 35 U.S.C. 154(b) by 0 days.

(21) Appl. No.: 15/585,233

(22) Filed: May 3, 2017

(65) Prior Publication Data

US 2017/0321459 A1 Nov. 9, 2017

Related U.S. Application Data

(60) Provisional application No. 62/331,057, filed on May 3, 2016.

(51) Int. Cl.
*E05C 19/00* (2006.01)
*E05C 17/36* (2006.01)

(52) U.S. Cl.
CPC ..... *E05C 19/00* (2013.01); *E05C 17/36* (2013.01)

(58) Field of Classification Search
CPC ..... E05C 17/36; E05C 19/00
See application file for complete search history.

(56) References Cited

U.S. PATENT DOCUMENTS 4,543,806 A * 10/1985 Papandrea ..... E05B 67/006 242/380
4,896,517 A * 1/1990 Ling ..... E05B 67/006 70/18
5,466,022 A * 11/1995 Derman ..... E05C 17/365 292/246
5,496,990 A * 3/1996 Gillieron ..... G07B 17/00193 235/101
5,716,084 A * 2/1998 Sanford, Jr. ..... E05C 17/365 292/246
5,908,213 A * 6/1999 Tippetts ..... E05C 19/184 292/246
5,916,283 A * 6/1999 Steinbach ..... A44B 15/00 70/38 A
5,960,652 A * 10/1999 Marmstad ..... E05B 73/0011 70/233
6,182,485 B1 * 2/2001 Moore ..... E05B 13/002 292/258
6,363,758 B1 * 4/2002 Ling ..... E05B 37/025 70/22
6,681,603 B1 * 1/2004 Yu ..... E05B 67/006 30/233
6,863,319 B1 * 3/2005 Bentley ..... E05C 17/36 292/253

(Continued)

*Primary Examiner* — Catherine A Kelly
(74) *Attorney, Agent, or Firm* — Trego, Hines & Ladenheim, PLLC

(57) ABSTRACT

A door security apparatus includes: a base defining a first anchor point and at least one second anchor point; a storage element carried by the base; and a flexible connector carried by the storage element and having a proximal end and a distal end, wherein the proximal end is connected to the first anchor point, the flexible connector being moveable between a first stored position within the storage element, and a second extended position.

17 Claims, 5 Drawing Sheets

(56) References Cited

U.S. PATENT DOCUMENTS

| | | | | |
|---|---|---|---|---|
| 7,152,439 | B1 * | 12/2006 | Chang | E05B 37/025 70/30 |
| 7,175,213 | B1 * | 2/2007 | Blangiardo | E05B 13/002 292/1 |
| 7,272,962 | B2 * | 9/2007 | Benda | E05B 67/006 70/18 |
| 7,543,466 | B2 * | 6/2009 | Loughlin | E05B 67/003 70/14 |
| 9,212,508 | B2 * | 12/2015 | Loughlin | E05B 67/003 |
| 9,528,302 | B2 * | 12/2016 | Loughlin | E05B 67/003 |
| 9,669,888 | B1 * | 6/2017 | Singleton | B62H 5/003 |
| 2004/0183315 | A1 * | 9/2004 | O'Donohoe | E05B 13/001 292/288 |
| 2014/0245798 | A1 * | 9/2014 | Beckman | E05B 19/00 70/14 |
| 2017/0191293 | A1 * | 7/2017 | Osburn | E05C 19/00 |

* cited by examiner

DOOR SECURITY DEVICE

BACKGROUND OF THE INVENTION

This invention relates generally to door security devices, and more particularly to a device for securing a door without using a conventional lock.

Residential and commercial buildings typically incorporate internal subdivisions (e.g. hallways and rooms) separated from each other by doors.

Under normal circumstances it is necessary or desirable that these doors remain unlocked to provide free access. It is also necessary to provide free egress in the event of an emergency situation such as a fire or building structural failure. Accordingly, such doors are often not provided with locks.

However, other emergency situations can arise in which it is desirable to secure these doors. For example, "active shooter" situations sometimes occur in which an armed perpetrator roams through a building, seeking people to injure or kill on an opportunistic basis.

In such situations it is desirable to lock internal doors in order to provide some measure of protection from gunfire and/or to slow down the progress of the perpetrator until law enforcement personnel can arrive.

Numerous prior art devices are available for securing doors which are not provided with conventional locks. Some of them are only able to secure doors in one direction, i.e. push or pull, while others require hardware to be mounted to a door permanently.

One problem with some prior art door security devices is that they require the use of fine motor control, which is known to be degraded or absent in stressful situations.

Another problem with some prior art door security devices is that they may require attaching one or more components to the door itself, which can be a violation of applicable building codes.

BRIEF SUMMARY OF THE INVENTION

At least one of these problems is addressed by a door security device including a flexible connector and first and second anchor points for the flexible connector.

According to one aspect of the technology described herein, a door security apparatus includes: a base defining a first anchor point and at least one second anchor point; a storage element carried by the base; and a flexible connector carried by the storage element and having a proximal end and a distal end, wherein the proximal end is connected to the first anchor point, the flexible connector being moveable between a first stored position within the storage element, and a second extended position.

According to another aspect of the technology described herein, a door security apparatus includes: a flat base including two or more cleats, each of the cleats having a generally V-shaped slot; a spool mounted for rotation about an axle which extends from the base; and a flexible connector carried on the spool and having a proximal end and a distal end, the proximal end being connected to the axle, the flexible connector being moveable between a first stored position within the spool, and a second extended position.

According to another aspect of the technology described herein, a door security apparatus includes: a wall structure; a door mounted in a door frame in the wall structure, the door moveable between open and closed positions; and a door security device mounted to the wall structure adjacent the frame, the device including: a base defining a first anchor point and at least one second anchor point, a storage element carried by the base; and a flexible connector carried by the storage element and having a proximal end and a distal end, wherein the proximal end is connected to the first anchor point, the flexible connector being moveable between a first stored position within the storage element, and a second extended position.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
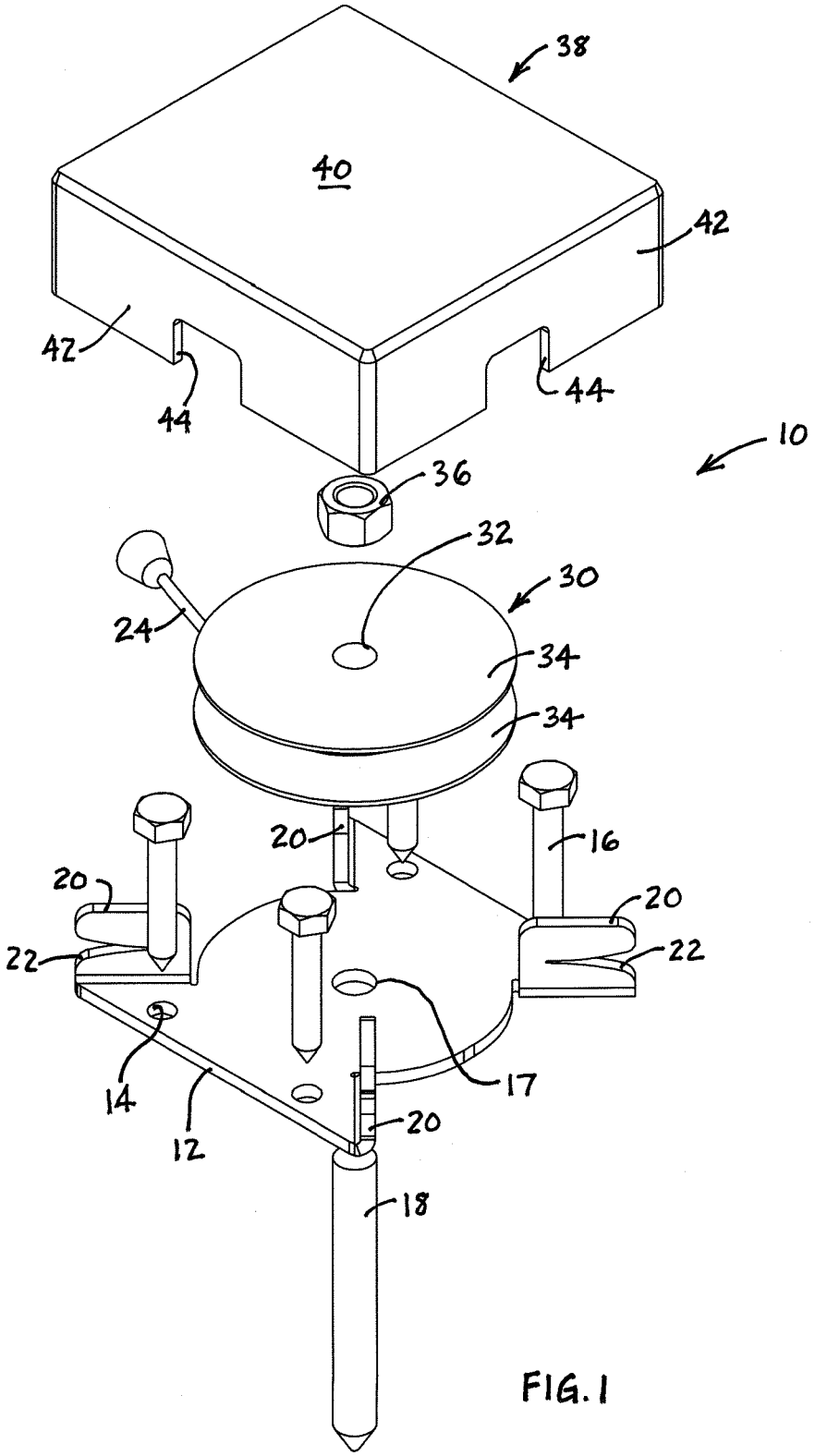
FIG. 1 is a schematic exploded perspective view of an exemplary door security device.
Figure 2:
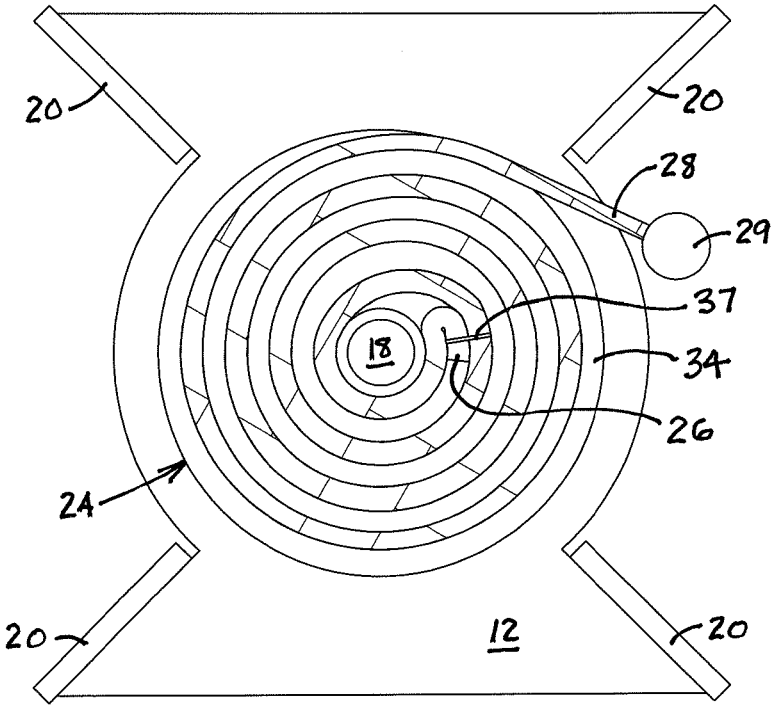
FIG. 2 is partially-sectioned view of the door security device of FIG. 1, showing a flexible connector mounted therein.

Referring to the drawings wherein identical reference numerals denote the same elements throughout the various views, FIGS. 1 and 2 illustrate an exemplary door security device 10.

The basic components of the door security device 10 are a first anchor point, a flexible connector, a storage element, and a second anchor point. Examples of these components will be described in more detail below.

The door security device 10 may include a base 12 which serves to mount and locate the other components. In the illustrated example, the base 12 is a generally planar element and may be formed from a material such as metal sheet or plate. The base 12 includes mounting holes 14 which accept fasteners such as the illustrated mounting screws 16. The base 12 may also include a central hole 17 which accepts an axle 18 that serves as the first anchor point.

The base 12 also defines the second anchor point. In the illustrated example, the base 12 incorporates a plurality of cleats 20 in the form of tabs which extend away from the base 12 at a perpendicular angle. Each of the cleats 20 incorporates a generally V-shaped slot 22 and functions to secure the flexible connector 24 as will be described in more detail below. In the illustrated example the cleats 20 are arranged in a radial array with their slots 22 facing outwards relative to the base 12. In lieu of the tab-shaped cleats 20, other kinds of cleats or cleat-like devices could be substituted.

The flexible connector 24 may comprise any material having suitable tensile strength to resist breaking and hold a door closed when a significant force is applied to the door. The exact tensile strength required will of course vary with a specific application. As an example, it is considered desirable that the flexible connector 24 be able to withstand a force of approximately 3.5 kN (800 lb.) applied to a door. Nonlimiting examples of suitable materials for the flexible connector 24 include ropes, cables, chains, and straps. In the illustrated example the flexible connector 24 comprises a braided rope formed from aramid fibers such as KEVLAR and having a proximal end 26 and a distal end 28 (see FIG. 2). In the illustrated example, a small knob 29 is connected to the distal end 28 of the flexible connector 24 to enable a user to readily grasp and pull the flexible connector 24.

Figure 7:
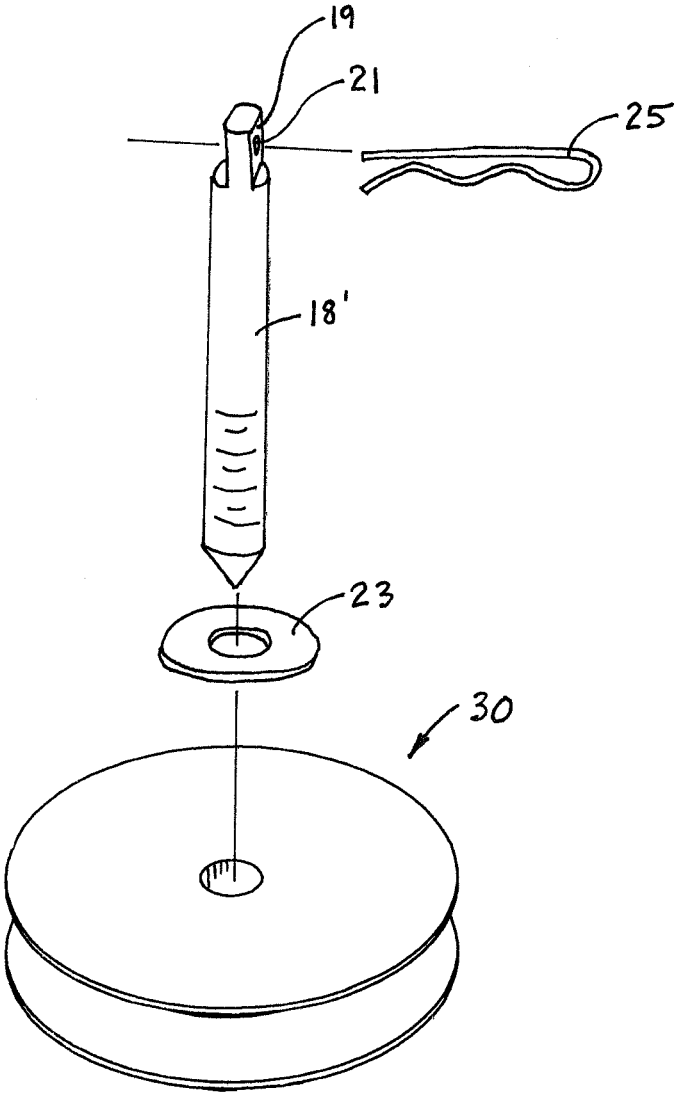
FIG. 7 is a schematic exploded perspective view showing an alternative bolt assembly.

The storage element may be any structure which stores the flexible connector 24 in a compact configuration and enables the flexible connector 24 to be deployed or removed rapidly and reliably. In the example illustrated in FIGS. 1 and 2, the storage element is a pulley or spool 30 having a central through hole 32 and a pair of spaced-apart flanges 34. In this example, a conventional bolt (such as a "hanger bolt") serves as the axle 18. The axle 18 passes through the central through hole 32 such that the spool 30 can rotate about the axle 18. In the illustrated example, a threaded nut 36 secures the spool 30 to the axle 18. Other types of fasteners may be used in place of the bolt and/or the threaded nut 36. For example, FIG. 7 illustrates an alternative axle 18' in the form of a conventional bolt (such as a "hanger bolt") having wrenching flats 19 formed at its upper end, and a hole 21 cross-drilled through the upper end. The wrenching flats 19 may be used to drive the axle 18' into wall structure. The spool 30 may be secured using a washer 23 and a fastener 25 such as a clip installed through the hole 21. A "hairpin" clip is shown in FIG. 7. As a further example, instead of using a separate bolt through a central hole 17, the axle 18 could be formed integral to the base 12. For example, a short section of cylindrical rod could be welded to the base 12. The proximal end 26 of the flexible connector 24 is connected to the axle 18, for example by being wrapped around the central portion of the spool 30, which surrounds the axle 18, and secured with a ferrule 37.

Figure 3:
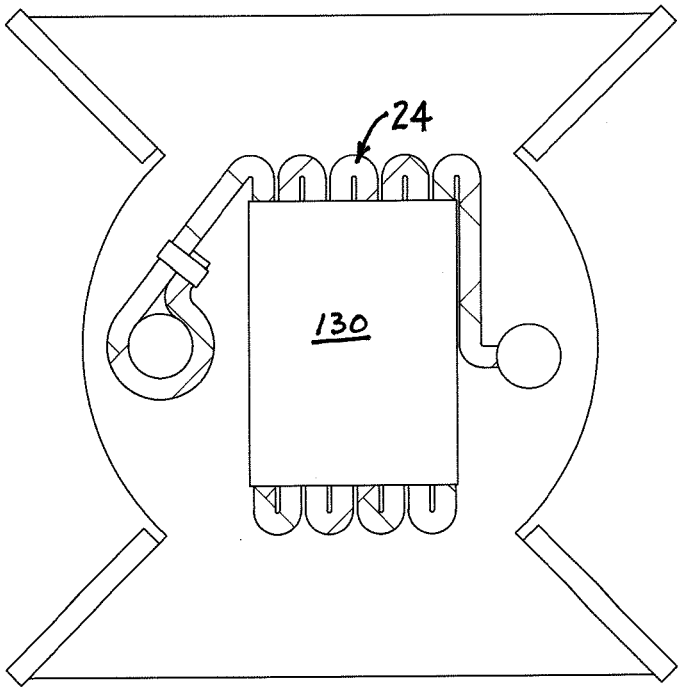
FIG. 3 is a view showing an alternative storage element.

An alternative storage element 130 is shown in FIG. 3 comprising a band of frangible material such as thin plastic sheet, paper, or card stock. The flexible connector 24 is folded in a compact configuration within the band 130, such as a zigzag shape. Nonlimiting examples of other frangible materials include string, tape or adhesives.

Optionally, the door security device 10 may include a cover or housing for the purpose of improving its appearance, protecting the internal components from dust or damage, and/or discouraging vandalism or accidental use. In the illustrated example, a cover 38 with a front wall 40 and four side walls 42 is provided which is sized and shaped to fit over the base 12 and may be retained thereto by means such as a friction fit, one or more tabs (not shown), or a similar mechanism. Optionally, to further discourage unauthorized use, the cover 38 may be retained to the base 12 by a means (not shown) such as one or more straps (e.g. metal straps) which require a significant force to break, or one or more mechanical or electronic locks. One or more of the side walls 42 includes a slot 44 formed therein to accept the flexible connector 24. The cover 38 may be made from an inexpensive lightweight material such as molded plastic and may include markings such as identification of the device or instructions.

Figure 4:
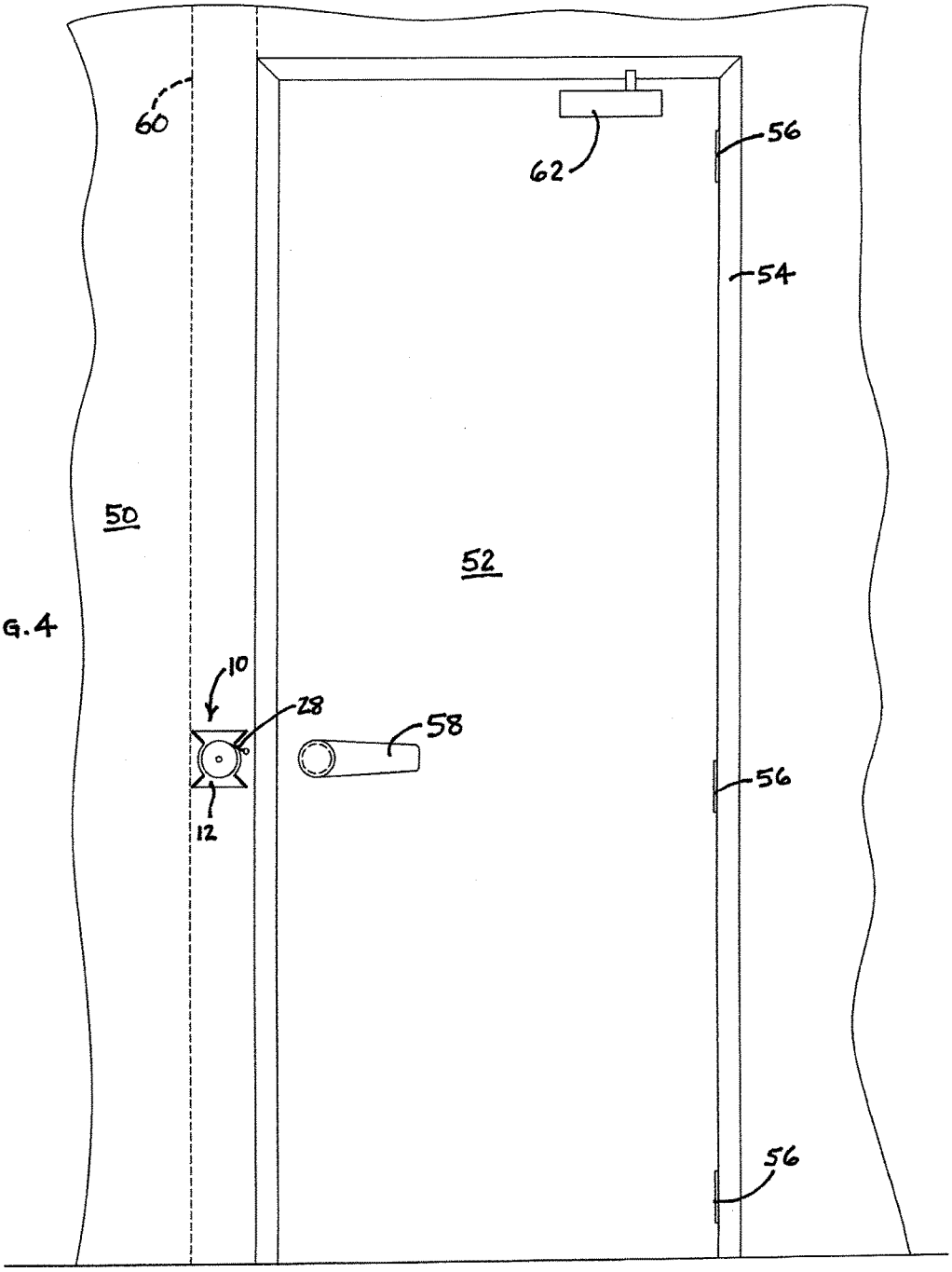
FIG. 4 is a schematic view showing the door security device of FIG. 1 mounted adjacent a door in a ready to use condition.

The door security device 10 would be installed by mounting the base 12 in close proximity to a door. FIG. 4 shows the door security device 10 mounted to a wall structure 50 adjacent a door 52 which is surrounded by a frame 54. The door 52 swings on hinges 56 between open and closed positions, and is provided with a handle 58. The present invention is also suitable for use with sliding doors or pocket doors. The door security device 10 may be mounted, for example, by driving the mounting screws 16 through the mounting holes 14 and the base 12, and into the wall structure 50 and/or the frame 54. Preferably, the base 12 is mounted into a structural member 60 of the wall structure 50, shown in dashed lines. It will be understood that mounting screws 16 may be replaced or supplemented by appropriate fasteners, anchors, etc. as required to secure the base 12 into the wall structure 50. For example, wood screws or lag screws may be used for wooden structure, lag screws with lag shields or other similar anchors may be used in masonry structure, and toggle bolts or other similar anchors may be used in metal or other hollow (thin-skinned) structure.

The door security device 10 may be mounted at any convenient height relative to the door 52 and may be mounted adjacent either face of the door 52 (i.e. in the interior or exterior of the room). The door security device 10 may also be mounted adjacent the hinge side or latch side of the door 52. Mounting adjacent the hinge side of the door 52 may be desirable where a door closer device 62 is present. If desired, it is also possible to mount the door security device 10 to the door 52 itself.

The door security device 10 is used as follows. In the ready condition, shown in FIG. 4, the proximal end 26 of the flexible connector 24 is secured to the first anchor point, which in this example is the axle 18, which is in turn anchored to the wall structure 50. The flexible connector 24 is stored in a compact condition or stored condition in the storage element (i.e. wound around the spool 30), and the distal end 28 of the flexible connector 24 is exposed, i.e. visible and reachable. If the optional cover 38 described above is used, it rests in place over the base 12 with a portion of the flexible connector 24 extending through one of the slots 44.

To use the door security device 10, a user simply pulls the exposed distal end 28 of the flexible connector 24 so that it extends out of the storage element (e.g. it reels out from the spool 30). This is an extended position of the flexible connector 24.

Figure 5:
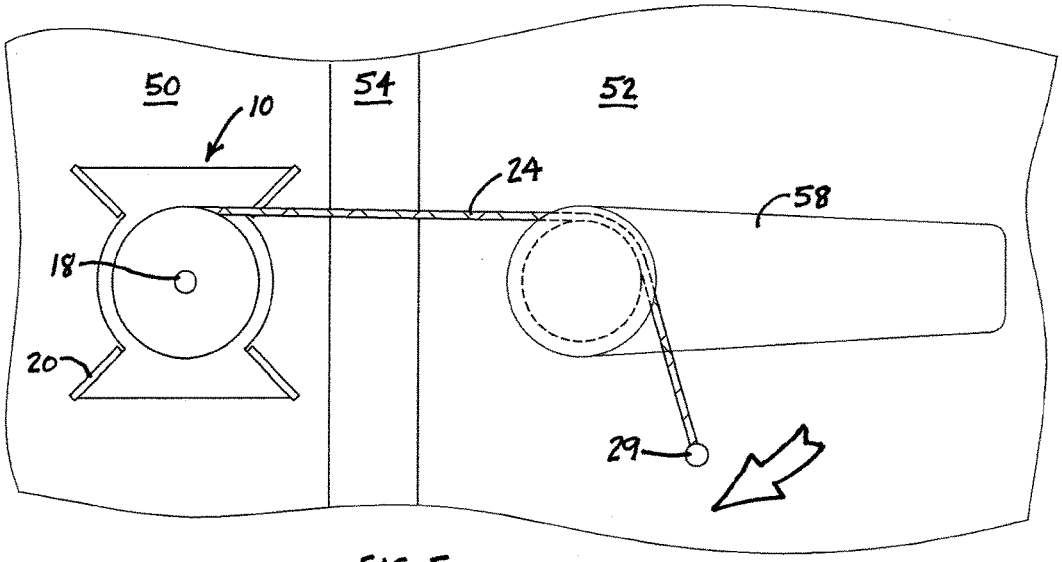
FIG. 5 is a schematic view showing the door security device of FIG. 1 in a partially deployed condition.

The flexible connector 24 is then wrapped one or more times around any available protrusion on the door 52. FIG. 5 shows the flexible connector 24 being wrapped around the door handle 58 described above.

Figure 6:
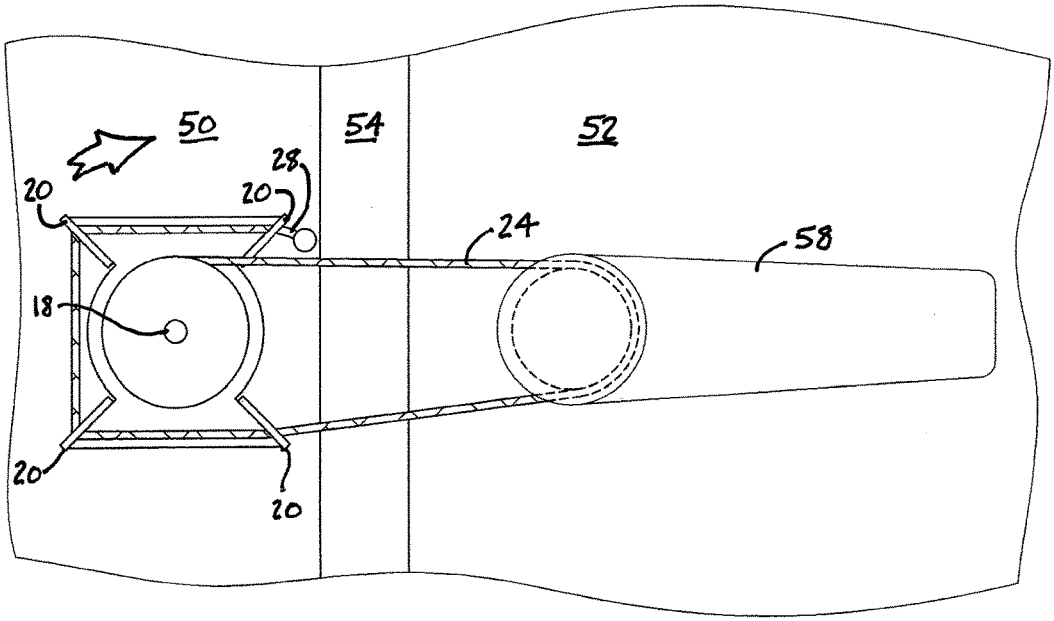
FIG. 6 is a schematic view showing the door security device of FIG. 1 in a use condition.

Subsequently, the flexible connector 24 is attached to the second anchor point. As shown in FIG. 6, this is achieved by simply wrapping the flexible connector 24 around the cleats 20 so that it enters the slots 22 and is retained in place. In practice, catching any one of the cleats 20 will provide at least some anchoring function to the distal end 28 of the flexible connector 24. The greater the number of the cleats 20 are engaged by the flexible connector 24, the more secure the connection.

The door security device 10 is simple and easy to use. The action of deploying the flexible connector 24 and engaging it with the cleats 20 requires only gross motor skills, which makes it more likely that a user can operate it properly during a stressful situation.

Once the flexible connector 24 has been secured, the door security device 10 in effect ties the free end of the door 52 to the base 12 and therefore functions to hold the door 52 in the closed position against both pushing and pulling movements. This potentially enables the door to serve as cover from gunfire and prevents a perpetrator from entering the room.

It is noted that the flexible connector 24 can be attached to any protrusion on the door 52, such as a knob, handle, push bar, latch or lock hardware, hook, or bracket. The flexible connector 24 can alternatively be wrapped around a door closer device 62 is described above which will also prevent the door 52 from being opened.

Alternatively, the flexible connector 24 may be used without the cleats 20. For example when used with a pair of meeting doors having adjacent handles (i.e. "French doors"), the flexible connector 24 could be employed by pulling it off the storage element and then wrapping or tying it around the adjacent door handles.

It is further noted that use of the flexible connector 24, for example by applying pressure to the door 52 or by repeatedly securing and removing the flexible connector 24, can cause wear to the flexible connector 24 which would make replacement desirable. When desired, flexible connector 24 and/or the storage element can be replaced without removing or replacing other components of the door security device 10. For example, after the door security device 10 has been used, the spool 30 and flexible connector 24 could be removed and replaced with a new spool pre-loaded with a fresh flexible connector 24.

It is also possible to remove the spool 30 and the flexible connector 24 and to substitute a "training spool" (not shown) comprising a spool and a flexible connector made from an inexpensive material. This training spool would then be used to practice operation of the door security device 10 without causing wear to the flexible connector 24. The spool 30 and flexible connector 24 may be replaced in the device to prepare it for actual use.

The foregoing has described a door security device. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A door security device, comprising:

a base defining a first anchor point and at least one second anchor point, wherein the at least one second anchor point includes a tab protruding from the base and having a V-shaped slot formed therein, the slot facing outwards relative to the base;

a storage element carried by the base; and a flexible connector carried by the storage element and having a proximal end and a free distal end, wherein the proximal end is connected to the first anchor point, the flexible connector being moveable between a first stored position within the storage element, and a second extended position in which the free distal end is positioned outside the base; and wherein in the second position, the flexible connector is capable of being wrapped around the around the base so as to engage the slot of the at least one second anchor point.

2. The device of claim 1, wherein the storage element comprises a spool mounted for rotation on an axle extending from the base, the axle defining the first anchor point.

3. The device of claim 2 wherein the spool is retained to the axle by a removable clip.

4. The device of claim 2, wherein the axle comprises a threaded bolt.

5. The device of claim 1, wherein the at least one second anchor point comprises a plurality of tabs protruding from the base, each of the tabs having a generally V-shaped slot formed therein which faces outwards relative to the base, wherein each of the tabs defines a second anchor point.

6. The device of claim 1, wherein the flexible connector comprises a rope formed from aramid fiber.

7. The device of claim 1, wherein the storage element comprises a band of frangible material surrounding the flexible connector.

8. The device of claim 1, further comprising a removable cover enclosing the storage element.

9. A door security apparatus, comprising:

a wall structure;

a door mounted in a door frame in the wall structure, the door moveable between open and closed positions; and the door security device of claim 1 mounted to the wall structure adjacent the frame.

10. A door security apparatus, comprising:

a flat base including two or more cleats, each of the cleats having a generally V-shaped slot, wherein the two or more cleats are arranged in a radial array with their slots facing outwards relative to the base;

a spool mounted for rotation about an axle which extends from the base; and a flexible connector carried on the spool and having a proximal end and a free distal end, the proximal end being connected to the axle, the flexible connector being moveable between a first stored position within the spool, and a second extended position in which the free distal end is positioned outside the base; and wherein in the second position, the flexible connector is capable of being wrapped around the around the base so as to engage the slots of the two or more cleats.

11. The apparatus of claim 10 wherein the spool is retained to the axle by a removable clip.

12. The apparatus of claim 10, wherein the axle comprises a threaded bolt.

13. The apparatus of claim 10, wherein the flexible connector comprises a rope formed from aramid fiber.

14. The apparatus of claim 10, further comprising a removable cover enclosing the storage element.

15. A door security apparatus, comprising:

a wall structure;

a door mounted in a door frame in the wall structure, the door moveable between open and closed positions; and a door security device mounted to the wall structure adjacent the frame, the device including:

a base defining a first anchor point and at least one second anchor point wherein the at least one second anchor point includes a tab protruding from the base and having a V-shaped slot formed therein, the slot facing outwards relative to the base, a storage element carried by the base; and a flexible connector carried by the storage element and having a proximal end and a free distal end, wherein the proximal end is connected to the first anchor point, the flexible connector being moveable between a first stored position within the storage element, and a second extended position in which the free distal end is positioned outside the base; and wherein in the second position, the flexible connector is capable of being wrapped around the around the base so as to engage the slot of the at least one second anchor point.

16. The apparatus of claim 15, wherein the at least one second anchor point comprises a plurality of tabs protruding from the base, each of the tabs having a generally V-shaped slot formed therein, wherein each of the tabs defines a second anchor point.

17. The apparatus of claim 15, wherein the flexible connector comprises a rope formed from aramid fiber.

* * * * *